United States Patent [19]

Michalowski

[11] 4,138,750

[45] Feb. 13, 1979

[54] APPARATUS FOR HANDLING DISABLED PERSONS

[76] Inventor: Joseph Michalowski, 5841 S. Nashville Ave., Chicago, Ill. 60638

[21] Appl. No.: 864,826

[22] Filed: Dec. 27, 1977

[51] Int. Cl.[2] ..... A61G 1/02

[52] U.S. Cl. ..... 5/89; 5/81 R; 5/86; 5/91

[58] Field of Search ..... 5/81 R, 86, 89, 91

[56] References Cited

U.S. PATENT DOCUMENTS

| | | | |
|---|---|---|---|
| 2,793,768 | 5/1957 | Schaedler | 5/89 |
| 3,234,568 | 2/1966 | Fischer | 5/89 |
| 3,829,916 | 8/1974 | James | 5/81 R |
| 4,070,721 | 1/1978 | Stasko | 5/89 |

*Primary Examiner*—Casmir A. Nunberg

[57] ABSTRACT

A sling or chair for transporting disabled persons having a seat and a pivoted back of hard rubber and strapping to support the patient on the seat and for transportation by appropriate lifts.

5 Claims, 10 Drawing Figures

FIG-1
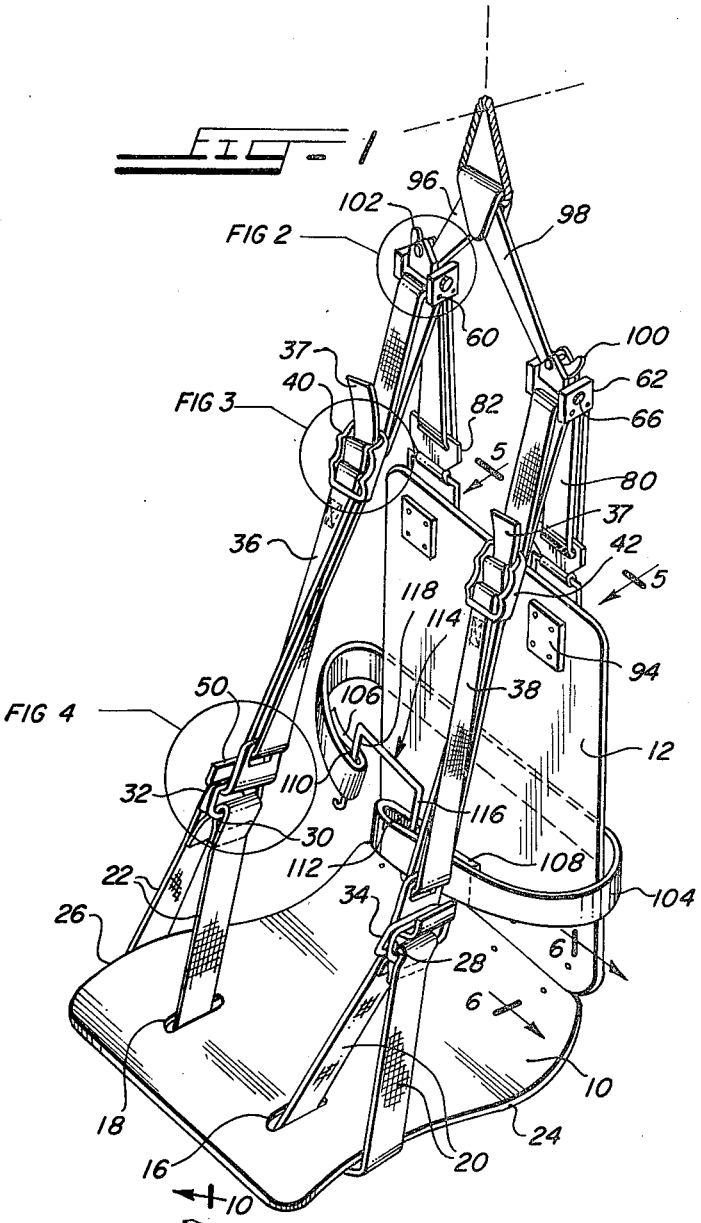
FIG-2
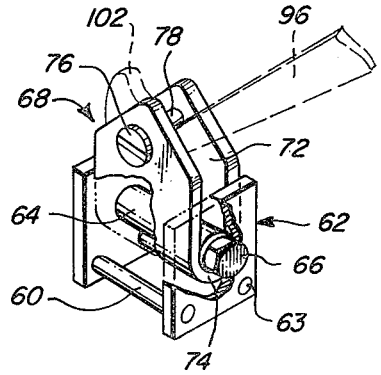
FIG-5
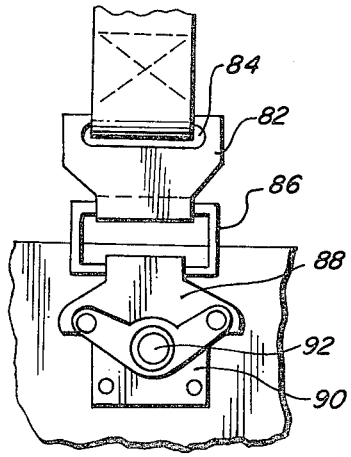
FIG-3
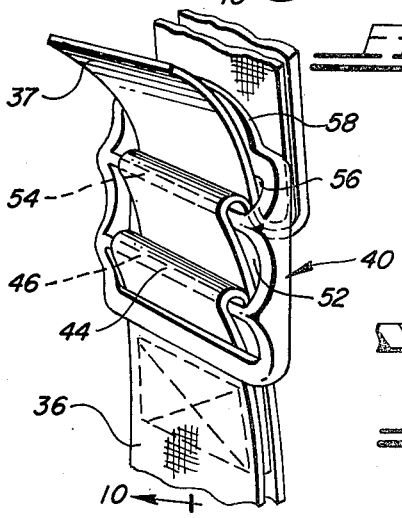
FIG-4
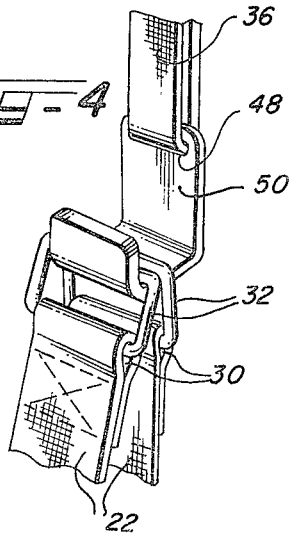
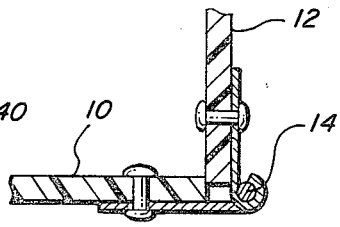
FIG-6

FIG. 7
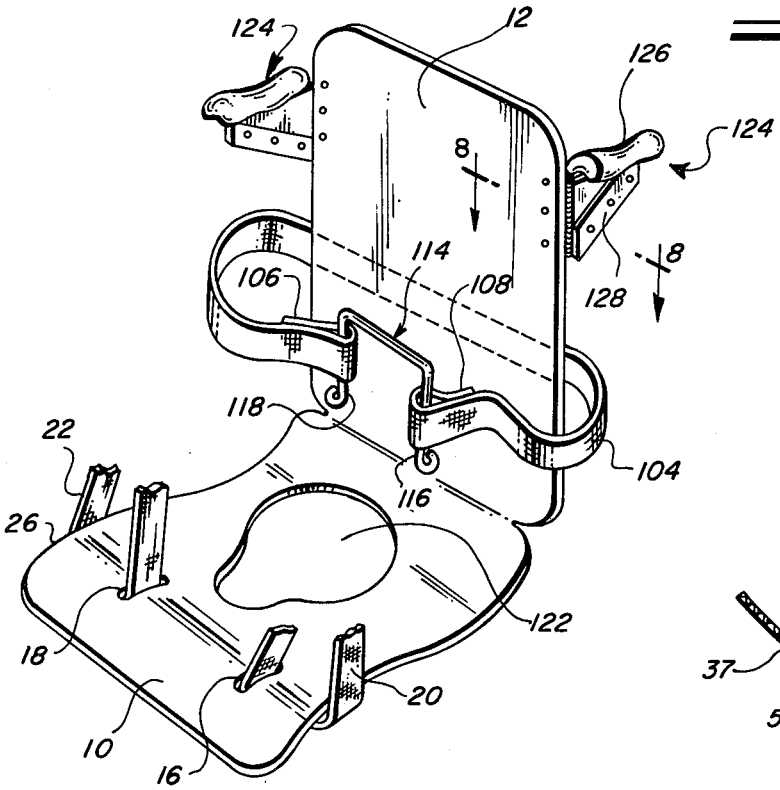
FIG. 8
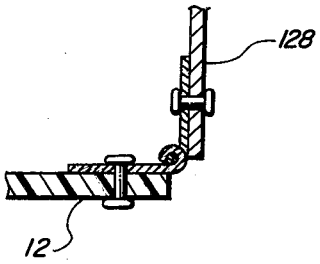
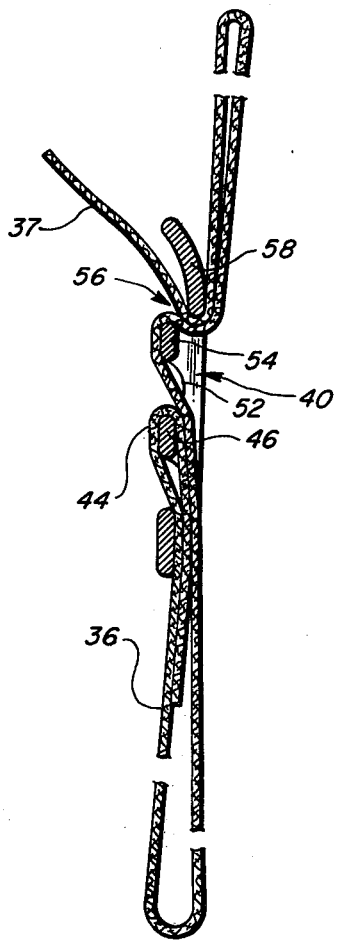
FIG. 10
FIG. 9
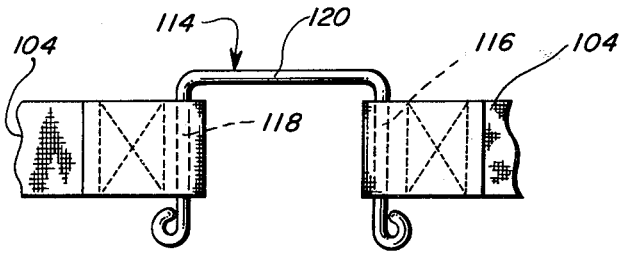

APPARATUS FOR HANDLING DISABLED PERSONS

BACKGROUND OF THE INVENTION

In hospitals, nursing homes and in private homes, it is often necessary to move or transport invalids and other bedridden patients from one place to another. Common vehicles used for this purpose are wheelchairs or wheel mounted stretchers. However, it is difficult to move persons safely. A variety of patient lifters have been employed to lift patients but these are extremely cumbersome and difficult to use.

The following patents were found in a search:

| | |
|---|---|
| 2,368,390 - 1/45 | 3,829,916 - 8/74 |
| 2,650,725 - 9/53 | 3,877,421 - 4/75 |
| 2,688,410 - 9/54 | 3,882,555 - 5/75 |
| 3,623,169 - 11/71 | 3,940,808 - 3/76 |
| 3,694,829 - 10/72 | 3,999,227 - 12/76 |
| 3,732,584 - 5/73 | |

None of the foregoing patents are believed to be pertinent to the present invention excepting all have seats, backs and a means for transporting the invalid and details of the present invention were lacking.

BRIEF DESCRIPTION OF THE DRAWINGS

FIG. 1 is a perspective view of the device of the present invention;

FIG. 2 is a perspective view taken from the circle indicated FIG. 2 on FIG. 1;

FIG. 3 is a perspective view taken from the circle indicated FIG. 3 on FIG. 1;

FIG. 4 is a perspective view taken from the circle indicated FIG. 4 on FIG. 1;

FIG. 5 is an elevational view taken on the line 5—5 of FIG. 1;

FIG. 6 is a cross-sectional view taken on the line 6—6 of FIG. 1;

FIG. 7 is a perspective view of a slight modification of FIG. 1;

FIG. 8 is a cross-sectional view taken on the line 8—8 of FIG. 7;

FIG. 9 is an enlarged fragmentary front elevational view of the latch and a portion of the body holding strap; and FIG. 10 is a cross-sectional view taken on the line 10—10 of FIG. 3.

SUMMARY OF THE INVENTION

A seat for transporting invalids comprising a semi-resilient contoured seat with a resilient back rest pivotally secured to the rear edges of the seat, and a series of adjustable straps extending from the sides of said seat and from the upper end of said back rest and said side straps and back straps joining together above said back rest ready for attachment to a mechanical sling. Said back rest has straps extending across the same on its rear face, secured thereto and having free ends extending beyond the side edges of said back to loop around the body of a person seated therein and anchored together to support the upper trunk of said body on said seat.

DETAILED DESCRIPTION OF THE DRAWINGS

The device of FIG. 1 shows a contoured seat 10 of a heavy semi-resilient material, such as rubber of about one-half inch thickness, and a back rest 12 of the same or different material hingedly secured to the seat portion by a piano hinge 14.

A pair of spaced elongated slots 16, 18 are provided adjacent the front and side edges, respectively, to receive webs 20, 22, respectively, which are threaded through said slots 16, 18, respectively, as seen in FIG. 1, and around the side edges 24, 26, respectively, of the seat 10. The free ends of each of the webs 20, 22 are turned back upon themselves and anchored to form loops 28, 30, respectively, to support metal ring-like members 32, 34. (See FIG. 4.) The webs 20, 28 are placed around the thighs of the legs of a person seated on the seat portion 10.

Second or long webs 36, 38 are secured at one end to buckle-like members 40, 42, respectively.

Since both of the webs and their appendages are identical, only one will be described.

The web 36 is bent back upon itself and secured together to form a loop 44, which loop is supported on the lower rod 46 of the buckle 40. The free end 37 of the web 36 then extends downwardly from the loop 44 and passes through a slot 48 in a hook 50 which is engaged in rings 32, 34, then extends upwardly and passes through the opening 52 between the rods 46 and 54 of the buckle 40 and thence over the rod 54 and into and through the second opening 56 between the rod 54 and the upper end 58 of the buckle, and thence behind the upper end 58 and upwardly behind and over rod 60 of bracket 62, and thence downwardly and through the opening 56 between the web extending therethrough as explained above and as shown in FIG. 3.

Thus, by shifting the free end 37 upwardly or downwardly, adjustment of the webs 36, 38 is effected between the hook 50 and the bracket 62, thus shortening or lengthening the web. It is to be noted in FIG. 1 that the web 36 is slightly twisted between the buckle 40 and the bracket 62.

The bracket 62 is also provided with a second spaced rod 63 and a sleeve 64 and nut and bolt 66. The bracket 68 has a pair of spaced legs 70, 72 and a connecting U-shaped member 74. The upper ends of the legs 70, 72 are tapered or rounded and they are each provided with an opposed aperture to receive nut and bolt 76, having a sleeve 78 on the bolt, to space the legs 70, 72 apart.

A third endless web 80 is positioned on rod 63 and on a pivot plate 82 and in the slotted aperture 84. The plate 82 is pivotally secured to a ring 86 which itself is pivotally secured to a pivoted plate 88. The plate 88 is secured to a backing plate 90 by pivot rivet 92. The plate 90 is riveted to the rear of the back rest 12 and to a square plate 94 on the front side thereof.

A well-known hydraulic lifter (not shown) is normally mounted on wheels and has an angularly disposed tubular arm on which is pivotally mounted angularly disposed fixed arms 96, 98 having hooked members 100, 102 for seating below and on the sleeves 64 whereby upon elevation of the lifter, the person seated in the device of the present invention will be elevated and readily moved.

To retain a person in the structure, a web 104 is fixedly secured to the rear of the back rest with the free ends 106, 108 bent back upon themselves and secured in any suitable manner to form loops 110, 112.

A U-shaped latching member 114 has a pair of spaced legs 116, 118 and a horizontally disposed connecting leg 120 with the free ends of the legs 116, 118 bent back upon themselves to form a rounded end. The latching member ties the web ends together with the legs 116, 118 positioned in the loops 112, 110, respectively.

In the modification shown in FIGS. 7 and 8, all the features of the main embodiment are the same but the modification has an opening 122 provided in the seat whereby a person in the sling may readily be suspended over the toilet bowl and use the toilet facilities while still sitting on the seat.

Also, a pair of shoulder supports 124 are pivotally secured one on each side of the back rest and appropriately padded as at 126 and strengthened as at 128, whereby a person disposed in the chair can place the rest under his armpit and be able to sit erect.

In operation, the device of the present invention is supported on the hooks 100, 102 and an invalid is placed on the seat 10 with his back against the back rest 12. The web 104 is moved around his waist and latched together with the latch member 114 in the manner shown in the drawings. The webs 20, 22 encircle the thigh of the invalid and the rings 32, 34 are engaged in the hooks 50. The end 37 of the webs 36, 38 are then adjusted in the buckles 40, 42 so that the seat is substantially horizontal. Thus the sling or chair is operational and the invalid cannot fall therefrom.

It is to be understood that numerous details may be omitted or altered without departing from the spirit of this invention as defined by the following claims.

I claim:

1. In an apparatus for handling disabled persons comprising a contoured semi-flexible seat, a semi-flexible back rest, a hinge to secure said back rest to the rear edge of said seat, spaced slotted perforations in said seat adjacent the side margins thereof and the front margins thereof, short webs extending through said perforations and the outer side edges of said seat, respectively, a ring secured to the free ends of each of said webs, elongated adjustable webs, bracket assemblies, each web engaging and extending downwardly from one of said bracket assemblies, a pair of hooks, each of said hooks secured to said elongated webs and engaging said rings, a buckle on each of said elongated webs through which the web extends for adjusting the length of each of said webs, spaced plates secured to said back rest, each having a slotted perforation, short endless webs each extending and secured to one of said bracket assemblies and the perforation in said plate, means on each of said bracket assemblies whereby the apparatus may be suspended from a lifter mechanism.

2. The device according to claim 1 wherein said endless webs are pivotally secured to said plate.

3. The device according to claim 2 wherein a web is anchored to the back rest and extends horizontally outward of said back rest, the free ends of said web being provided with loops, and anchoring means to link the free ends of said web together, whereby said web will extend around the stomach or chest of a person sitting on said seat to retain said person in said apparatus.

4. The device according to claim 3 wherein said anchoring means is an elongated, inverted, U-shaped rod-like member.

5. The device according to claim 4 wherein an opening is provided in said seat whereby a person in said apparatus can use the toilet facilities without removal from said apparatus.

* * * * *